US005277992A

United States Patent [19]

Shinohara et al.

[11] Patent Number: 5,277,992

[45] Date of Patent: Jan. 11, 1994

[54] THERMAL TRANSFER INK SHEET

[75] Inventors: Satoru Shinohara; Hiroshi Nakano; Yoshio Fujiwara; Tetsuya Abe, all of Kanagawa, Japan

[73] Assignee: Sony Corporation, Tokyo, Japan

[21] Appl. No.: 913,624

[22] Filed: Jul. 16, 1992

[30] Foreign Application Priority Data

Jul. 17, 1991 [JP] Japan ..... 3-20553

[51] Int. Cl.[5] ..... B41M 5/00

[52] U.S. Cl. ..... 428/704; 428/195; 428/488.4; 428/913

[58] Field of Search ..... 428/195, 913, 914, 323, 428/338, 409, 419, 480, 483, 488.4, 500, 220, 704

[56] References Cited

U.S. PATENT DOCUMENTS 4,420,528 12/1983 Okiyama ..... 428/220
4,950,641 8/1990 Hann et al. ..... 428/480
4,963,522 10/1990 Egashira et al. ..... 428/195

OTHER PUBLICATIONS

European Patent Application 0,137,741 Nov. 9, 1984 Takashi.
European Patent Application 0,401,878 Dec. 12, 1990 Naotake.
JP-A-60-094-394 Watanabe Sep. 28, 1985.
Patent Abstracts of Japan vol. 9, No. 142 (M-417) (1965).
JP-A-62-19,492 Watanabe Jun. 24, 1987.
Patent Abstracts of Japan vol. 11, No. 196 (M-601) (2643).

*Primary Examiner*—Patrick J. Ryan
*Assistant Examiner*—William A. Krynski
*Attorney, Agent, or Firm*—Hill, Steadman & Simpson

[57] ABSTRACT

A thermal transfer ink sheet composed of a substrate, a thermal transfer ink layer formed on one side of the substrate, and a back coat layer formed on the other side of the substrate, characterized in that the back coat layer has a kinetic friction coefficient smaller than 0.25 (with respect to the thermal head) which varies depending on whether printing is going on or not, such that it has a value of $\mu_1$ when printing is going on and a value of $\mu_2$ when printing is not going on, with the ratio of $\mu_1/\mu_2$ being from 0.8 to 1.2. The kinetic friction coefficient in the specified range can be obtained by employing a slip agent which does not greatly change the kinetic friction coefficient of the back coat layer depending on whether printing is going on or not, or by employing two slip agents in combination, one giving the back coat layer a kinetic friction coefficient which is higher when printing is going on than when printing is not going on, the other giving the back coat layer a kinetic friction coefficient which is lower when printing is going on than when printing is not going on. The thermal transfer ink sheet runs smoothly without imposing unnecessary loads to the thermal head and hence gives rise to a high-quality print image free of printing pitch fluctuation.

6 Claims, 2 Drawing Sheets

THERMAL TRANSFER INK SHEET

BACKGROUND OF THE INVENTION

1. Field of the Invention

The present invention relates to a thermal transfer ink sheet to be used for the printing of an image on printing paper by means of a thermal head, and more particularly, to a thermal transfer ink sheet provided with a back coat layer having a kinetic friction coefficient within a certain range for the elimination of printing pitch fluctuation.

2. Description of the Prior Art

There are two kinds of thermal transfer ink sheets—that of hot-melt transfer type and that of thermal dye (sublimation) transfer type. Both of them are constructed such that the substrate sheet has an ink layer (of either sublimation type or thermal transfer type) on one side thereof and a back coat layer on the other side thereof. The back coat layer prevents the thermal transfer ink sheet from sticking to the thermal head, thereby ensuring its smooth run. It is usually made of a heat-resistant resin such as silicone resin, fluorocarbon resin, acrylsilicone resin, and nitrocellulose resin, containing or not containing a slip agent such as silicone oil, fluorocarbon powder, and high-molecular weight slip polymer.

The conventional thermal transfer ink sheet has a disadvantage that it causes the printing pitch fluctuation because the back coat layer greatly varies in the kinetic friction coefficient depending on whether printing is going on or not. This holds true particularly of that of sublimation type which needs higher printing energy than that of hot-melt type and hence has a back coat layer which is formed so as to exhibit the maximum slip properties and heat resistance at the time of printing.

The printing pitch fluctuation is salient in the printing of digital signals, in which case the printing position is greatly dislocated, and in the printing of gradated images, in which case the image density greatly varies from one point to another.

FIG. 1 illustrates how the printing pitch fluctuation occurs in the printing by a line printer. FIGS. 2 and 3 show the examples of printing pitch fluctuation.

In FIG. 1, the thermal head of a line printer is schematically shown together with its nearby components. The thermal head 1 is opposite to the platen 2, with the thermal transfer ink sheet 3 interposed between them such that the thermal head 1 heats the thermal transfer ink sheet 3 through its back coat layer, thereby transferring an image onto the printing paper 4. The platen 2 turns to run the thermal ink sheet 3 and printing paper 4 in their respective directions indicated by arrows.

In the case of the printer constructed as mentioned above, the thermal head 1 have resistors whose center is slightly offset from the center of the platen 2 in anticipation of the thermal head 1 deforming during printing, (as indicated by a). During printing, the thermal head 1 receives a load in the rightward direction due to friction between the thermal head 1 and the thermal ink sheet 3. This load deforms the thermal head 1 rightward, causing the center of the resistor to coincide with the center of the platen 2, (as indicated by b). Ink transfer takes place when the resistor is at this position. However, smooth ink transfer will not take place if the back coat layer 3 of the thermal transfer ink sheet 3 varies in the kinetic friction coefficient depending on whether printing is going on or not. Such variation causes the thermal head 1 to deform in different amounts, and hence to cause the center position of the resistor to vary, depending on whether printing is going or not. This is the reason for the image pitch fluctuation.

If the kinetic friction coefficient is small when printing is going on and large when printing is not going on, the center of the resistor 1 will be at position c and position d, respectively, as shown in FIG. 1. This situation poses a problem in the case where a long line and a short line are printed alternately and repeatedly, with a blank line interposed between them, as shown in FIG. 2. When a long line is being printed, the center of the resistor is at position c in FIG. 1; however, when a short line is being printed or no printing is being performed, the center of the resistor is at position d in FIG. 1. The result is that the long lines and short lines to be printed at the same intervals (i=ii) are printed at different intervals (i<ii), as shown in FIG. 2. The foregoing also applies to the printing of halftone with blanks. In this case, thick lines (iii) and thin lines (iv) appear on the printing paper, as shown in FIG. 3.

What is shown in FIGS. 2 and 3 is true of the case where the kinetic friction coefficient is large when printing is going on and small when printing is not going on. However, the situation may be reversed, in which case the printing of alternating long and short lines, with a blank line interposed between them, has uneven intervals (i>ii) or the printing of halftone with blanks has thin lines (iii) and thick lines (iv).

The present invention was completed to solve the problem associated with the printing pitch fluctuation which occurs when the conventional thermal transfer ink sheet is employed. It is an object of the present invention to provide a thermal transfer ink sheet which runs smoothly without imposing unnecessary loads to the thermal head, thereby producing a high-quality transferred image free from printing pitch fluctuation even in the case of printing by digital signals.

SUMMARY OF THE INVENTION

The present invention is embodied in a thermal transfer ink sheet composed of a substrate, a thermal transfer ink layer formed on one side of the substrate, and a back coat layer formed on the other side of the substrate, characterized in that the back coat layer has a kinetic friction coefficient smaller than 0.25 (with respect to the thermal head) which varies depending on whether printing is going on or not, such that it has a value of $\mu_1$ when printing is going on and a value of $\mu_2$ when printing is not going on, with the ratio of $\mu_1/\mu_2$ being from 0.8 to 1.2.

The thermal transfer ink sheet runs smoothly without imposing unnecessary loads to the thermal head, thereby producing a high-quality transferred image free from printing pitch fluctuation.

DESCRIPTION OF THE PREFERRED EMBODIMENTS

Figure 1:
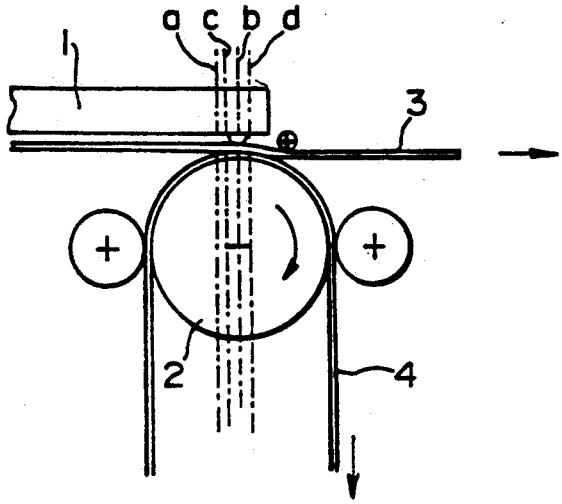
FIG. 1 is a schematic diagram showing the thermal head and its nearby components of a line printer.

The thermal transfer ink sheet of the present invention is composed of a substrate, a thermal transfer ink layer formed on one side of the substrate, and a back coat layer formed on the other side of the substrate, and is characterized in that the back coat layer has a kinetic friction coefficient smaller than 0.25 (with respect to the thermal head) which varies depending on whether printing is going on or not, such that it has a value of $\mu_1$ when printing is going on and a value of $\mu_2$ when printing is not going on, with the ratio of $\mu_1/\mu_2$ being from 0.8 to 1.2.

According to the present invention, the back coat layer has a kinetic friction coefficient (with respect to the thermal head) which is controlled within a certain range, so as to eliminate the printing pitch fluctuation which occurs when the kinetic friction coefficient varies depending on whether printing is going or not.

In other words, the back coat layer has a kinetic friction coefficient smaller than 0.25, preferably from 0.05 to 0.2, with respect to the thermal head when printing is going on or not. With a value larger than 0.25, the thermal transfer ink sheet is liable to stick to the thermal head. With a value smaller than 0.05, the thermal transfer ink sheet is liable to uncontrollable run and also to meandering at the time of slitting.

According to the present invention, the back coat layer should have a kinetic friction coefficient ($\mu_1$) when printing is going and also have a kinetic friction coefficient ($\mu_2$) when printing is not going on, with the ratio $\mu_1/\mu_2$ being from 0.8 to 1.2. With a ratio outside this range, the printing pitch fluctuation becomes serious.

The back coat layer having a kinetic friction coefficient within a certain range may be formed from a properly selected heat-resistant resin, slip agent, crosslinking agent, and filler, and other additives. The slip agent may be a single agent that meets the above-mentioned requirements or a combination of two agents, one increasing $\mu_1$ and the other decreasing $\mu_1$. By the adequate selection of a slip agent or a combination of two slip agents, it is possible to keep the ratio $\mu_1/\mu_2$ within 0.8–1.2, or it is even possible to bring the ratio $\mu_1/\mu_2$ close to 1.

The slip agent that gives the back coat layer a kinetic friction coefficient $\mu_1$ when printing is going on and a kinetic friction coefficient $\mu_2$ when printing is not going on, with the ratio $\mu_1/\mu_2$ being 0.8–1.2, is tri(p-olyoxyethylene alkylether) phosphate represented by the formula (1) below $$[C_mH_{2m+1}-O-(CH_2CH_2O)_n-]_3-\overset{\overset{\displaystyle O}{\|}}{P} \quad (1)$$

(where m is an integer of 10–20, and n is an integer of 1–20.)

or a glycerophospholipid or a combination thereof. The former includes tri(polyoxyethylene (2 mols) alkyl ether) phosphate ("Nikkol TDP-2") and tri(polyoxyethyethylene (10 mols) alkyl ether) phosphate ("Nikkol TDP-10"), both commercially available from Nikko Chemicals Co., Ltd. The glycerophospholipid should be selected from yolk lecithin, phosphatidylcholine, and phosphatidylserine.

The slip agent should be used in an amount of 5–35 wt %, preferably 10–30 wt %, for the solids (binder resin and crosslinking agent) contained in the back coat layer. With an amount less than 5 wt %, the slip agent does not produce the desired effect and hence the back coat layer is liable to sticking. With an amount in excess of 35 wt %, the slip agent makes the back coat layer sticky, resulting in blocking between the ink layer and the back coat layer.

The slip agent that gives the back coat layer a kinetic friction coefficient which is higher when printing is going on than when printing is not going on, should be at least one species selected from the group consisting of a long-chain fatty acid alkyl ester represented by the formula (2) below, $$R_1\overset{\overset{\displaystyle O}{\|}}{C}-OR_2 \quad (2)$$

(where $R_1$ denotes a $C_{7-19}$ alkyl or alkenyl group, and $R_2$ denotes a $C_{1-20}$ alkyl group.)

a long-chain fatty acid amide represented by the formula (3) below, $$R\overset{\overset{\displaystyle O}{\|}}{C}-NH_2 \quad (3)$$

(where R denotes a $C_{7-19}$ alkyl or alkenyl group.)

paraffin wax, an alkyl phosphate represented by the formula (4) below, $$C_nH_{2n+1}O-\overset{\overset{\displaystyle O}{\|}}{P}(OH)_2 \quad (4)$$

(where n is an integer of 10–18.)

and a lubricating polymer. Examples of the long-chain fatty acid alkyl ester include butyl stearate, isopropyl myristate, ethyl oleate, and octyldodecyl myristate. Examples of the long-chain fatty acid amide include stearamide and erucamide. Examples of the alkyl phosphate include "Phosten HLP", a product of Nikko Chemicals Co., Ltd. Examples of the lubricating polymer include acrylsilicone graft polymer ("Simac US380", a product of Toagosei Chemical Industry Co., Ltd.)

The slip agent that gives the back coat layer a kinetic friction coefficient which is lower when printing is going on than when printing is not going on, should be at least one species selected from the group consisting of sodium polyoxyethylene oleyl ether phosphate represented by the formula (5) below, $$[C_{18}H_{35}O-(CH_2CH_2O)_n-]_m-\overset{\overset{\displaystyle O}{\|}}{P}(ONa)_{3-m} \quad (5)$$

(where n is an integer of 1–20, and m is 1 or 2.)

polyoxyethylene dodecylphenyl ether phosphate represented by the formula (6) below, $$[C_{12}H_{25}-C_6H_4-O-(CH_2CH_2O)_n-]_m-\overset{\overset{\displaystyle O}{\|}}{P}(OH)_{3-m} \quad (6)$$

(where n is an integer of 1–20, and m is 1 or 2.)

polyoxyethylene alkyl ether phosphate represented by the formula (7) below, $$[C_kH_{2k+1}-O-(CH_2CH_2O)_n-]_m-\overset{\overset{\displaystyle O}{\|}}{P}(OH)_{3-m} \quad (7)$$

(where k is an integer of 10–20, n in an integer of 1–20, and m is 1 or 2.)

and alkoxyl acid phosphate represented by the formula (8) below.

$$(C_nH_{2n+1}O)_m-\overset{\overset{\displaystyle O}{\|}}{P}(OH)_{3-m} \quad (8)$$

(where n is an integer of 20–24, and m is 1 or 2.)

Examples of the sodium polyoxyethylene alkyl ether phosphate include "GAFAC RD-720", a product of Toho Kagaku Kogyo Co., Ltd. Examples of the polyoxyethylene dodecyl phenyl ether phosphate include "Plysurf A208S", a product of Dai-ichi Kogyo Seiyaku Co., Ltd. Examples of the polyoxyethylene alkyl ether phosphate include polyoxyethylene (2 mols) alkyl ether phosphate ("Nikkol DDP-2") and polyoxyethylene (2 mols) alkyl ether phosphate ("Nikkol DDP-10"), products of Nikko Chemicals Co., Ltd. Examples of the alkoxyl acid phosphate include "JP-524", a product of Johoku Kagaku Co., Ltd.

In the case where two slip agents are used in combination with each other, one giving a higher kinetic friction coefficient and the other giving a lower kinetic friction coefficient, their mixing ratio should be from 1:10 to 10:1. With a mixing ratio outside this range, they do not produce the desired effect.

The back coat layer mentioned above can be formed by application onto the substrate sheet (primed or not primed) in the usual way from a solvent solution containing the constituents.

The thermal transfer ink sheet of the present invention may take on any form (hot-melt type or sublimation type) so long as it has the above-mentioned back coat layer. For example, a thermal transfer ink sheet of hot-melt type may be composed of a back coat layer, a substrate sheet, and a thermal transfer ink layer (containing wax, dye, pigment, etc.) placed on top of the other. A thermal transfer ink sheet of sublimation type may be composed of a back coat layer, a substrate sheet, and a thermal transfer ink layer (containing a binder and subliming dye) placed on top of the other. The present invention places no restrictions on other layers than the back coat layer as to their constituents and forming process. The thermal transfer ink sheet may have a primer layer in addition to the above-mentioned layers, according to need.

Functions

Since the back coat layer has a kinetic friction coefficient lower than 0.25 (with respect to the thermal head) when printing is going on or not going on, the thermal transfer ink sheet of the present invention runs smoothly without sticking to the thermal head. Moreover, since the back coat layer has a kinetic friction coefficient $\mu_1$ when printing is going on and a kinetic friction coefficient $\mu_2$ when printing is not going on, with the ratio $\mu_1/\mu_2$ being in the range of 0.8–1.2, the thermal transfer ink sheet runs smoothly without causing the printing pitch fluctuation, thereby giving rise to high-quality printing.

EXAMPLES

The invention will be described in more detail with reference to the following examples.

EXAMPLE 1

On one side of a 6-μm thick PET film was formed a 0.1-μm thick primer layer from the primer solution (1) of the following composition by coating with a coil bar #5, followed by drying at 120° C. for 2 minutes.

| Primer solution (1) | |
|---|---|
| Polyester urethane (DN3870 made by Nippon Polyurethane Kogyo Co., Ltd.) | 10 pbw |
| Nitrocellulose (25% solution) (PML25 made by Fujikura Kasei Co., Ltd.) | 10 pbw |
| Trifunctional polyisocyanate crosslinking agent (Colonate L made by Nippon Polyurethane Kogyo Co., Ltd.) | 1 pbw |
| MEK | 100 pbw |
| Cyclohexanone | 100 pbw |

The primer layer was coated with a 1.0-μm thick back coat layer from the back coat solution of the following composition by coating with a coil bar #10, followed by drying at 120° C. for 2 minutes.

| Back coat solution | |
|---|---|
| Heat-resistant binder (cellulose acetate) (L-70 made by Daicel Chemical Industries Co., Ltd.) | 10 pbw |
| Slip agent (acryl-silicone graft polymer 30% solution) (AS-005 made by Fujikura Kasei Co., Ltd.) | 8 pbw |
| Slip agent (polyoxyethylene dodecylphenyl ether phosphate) (Plysurf A208S made by Dai-ichi Kogyo Seiyaku Co., Ltd.) | 4 pbw |
| Acetone | 200 pbw |
| Cyclohexanone | 200 pbw |

On the other side of the PET film was formed a 0.1-μm thick primer layer from the primer solution (2) of the following composition by coating with a coil bar #5, followed by drying at 120° C. for 2 minutes.

| Primer solution (2) | |
|---|---|
| Polyester urethane (DN3870 made by Nippon Polyurethane Kogyo Co., Ltd.) | 10 pbw |
| Trifunctional polyisocyanate crosslinking agent (Colonate L made by Nippon Polyurethane Kogyo Co., Ltd.) | 0.5 pbw |
| MEK | 100 pbw |
| Cyclohexanone | 100 pbw |

On this primer layer was formed a 1.0-μm thick ink layer from the ink solution of the following composition by coating with a coil bar #14, followed by drying at 120° C. for 2 minutes.

| Ink solution | |
|---|---|
| Ethylhydroxyethylcellulose (low) (made by Hercules Inc.) | 10 pbw |
| A dye represented by the formula below | 3 pbw |

-continued

| Ink solution | |
|---|---|
| 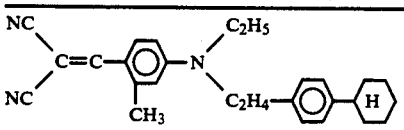 | |
| MEK | 50 pbw |
| Toluene | 50 pbw |

Thus there was obtained a thermal transfer ink sheet of sublimation type.

EXAMPLE 2

The same procedure as in Example 1 was repeated to prepare a thermal transfer ink sheet of sublimation type, except that the back coat solution was replaced by that of the following composition.

| Back coat solution | |
|---|---|
| Heat-resistant binder (cellulose acetate) (L-70 made by Daicel Chemical Industries Co., Ltd.) | 10 pbw |
| Slip agent (acryl-silicone graft polymer 30% solution) (AS-005 made by Fujikura Kasei Co., Ltd.) | 33 pbw |
| Slip agent (sodium polyoxyethylene dodecylphenyl ether phosphate) (GAFAC RD720 made by Toho Kagaku Kogyo Co., Ltd.) | 5 pbw |
| Trifunctional polyisocyanate crosslinking agent (Colonate L made by Nippon Polyurethane Kogyo Co., Ltd.) | 44 pbw |
| Acetone | 200 pbw |
| Cyclohexanone | 200 pbw |

EXAMPLE 3

The same procedure as in Example 1 was repeated to prepare a thermal transfer ink sheet of sublimation type, except that the back coat solution was replaced by that of the following composition.

| Back coat solution | |
|---|---|
| Heat-resistant binder (cellulose acetate) (L-70 made by Daicel Chemical Industries Co., Ltd.) | 10 pbw |
| Slip agent (yolk lecithin) (Y-10 made by Nikko Chemicals Co., Ltd.) | 1 pbw |
| Cyclohexanone | 500 pbw |

EXAMPLE 4

The same procedure as in Example 1 was repeated to prepare a thermal transfer ink sheet of sublimation type, except that the back coat solution was replaced by that of the following composition.

| Back coat solution | |
|---|---|
| Heat-resistant binder (cellulose acetate) (L-70 made by Daicel Chemical Industries Co., Ltd.) | 10 pbw |
| Slip agent (polyoxyethylene dodecylphenyl ether phosphate) (Plysurf A208S made by Dai-ichi Kogyo Seiyaku Co., Ltd.) | 1.5 pbw |
| Slip agent (yolk lecithin) (Y-10 made by Nikko Chemicals Co., Ltd.) | 1.5 pbw |

-continued

| Back coat solution | |
|---|---|
| Cyclohexanone | 500 pbw |

EXAMPLE 5

The same procedure as in Example 1 was repeated to prepare a thermal transfer ink sheet of sublimation type, except that the back coat solution was replaced by that of the following composition.

| Back coat solution | |
|---|---|
| Heat-resistant binder (polyvinyl butyral) (Eslec BX55Z made by Sekisui Chemical Co., Ltd.) | 10 pbw |
| Slip agent (tri-polyoxyethylene (2 mols) alkyl ether phosphate) (Nikkol TDP-2 made by Nikko Chemicals Co., Ltd.) | 5 pbw |
| Trifunctional polyisocyanate crosslinking agent (45 wt % solution) (Colonate L-45E made by Nippon Polyurethane Kogyo Co., Ltd.) | 30 pbw |
| Toluene | 100 pbw |
| MEK | 100 pbw |

EXAMPLE 6

The same procedure as in Example 1 was repeated to prepare a thermal transfer ink sheet of sublimation type, except that the back coat solution was replaced by that of the following composition.

| Back coat solution | |
|---|---|
| Heat resistant binder (polyvinyl butyral) (Eslec BX55Z made by Sekisui Chemical Co., Ltd.) | 10 pbw |
| Slip agent (tri-polyoxyethylene (10 mols) alkyl ether phosphate) (Nikkol TDP-10 made by Nikko Chemicals Co., Ltd.) | 4 pbw |
| Trifunctional polyisocyanate crosslinking agent (45 wt % solution) (Colonate L-45E made by Nippon Polyurethane Kogyo Co., Ltd.) | 10 pbw |
| Filler (calcium carbonate) ("Hakuenka DD" made by Shiraishi Calcium Co., Ltd.) | 1 pbw |
| Toluene | 100 pbw |
| MEK | 100 pbw |

EXAMPLE 7

The same procedure as in Example 1 was repeated to prepare a thermal transfer ink sheet of sublimation type, except that the back coat solution was replaced by that of the following composition.

| Back coat solution | |
|---|---|
| Heat-resistant binder (polyvinyl butyral) (Eslec BX55Z made by Sekisui Chemical Co., Ltd.) | 10 pbw |
| Slip agent (polyoxyethylene dodecyl phenyl ether phosphate) (Plysurf A208S made by Dai-ichi Kogyo Seiyaku Co., Ltd.) | 2 pbw |
| Slip agent (butyl stearate) (made by Kawaken Fine Chemical Co., Ltd.) | 2 pbw |
| Trifunctional polyisocyanate crosslinking agent (45 wt % solution) (Colonate L-45E made by Nippon Polyurethane | 10 pbw |

-continued

| Back coat solution | |
|---|---|
| Kogyo Co., Ltd.) | |
| Toluene | 100 pbw |
| MEK | 100 pbw |

EXAMPLE 8

The same procedure as in Example 1 was repeated to prepare a thermal transfer ink sheet of sublimation type, except that the back coat solution was replaced by that of the following composition.

| Back coat solution | |
|---|---|
| Heat-resistant binder (polyvinyl butyral) (Eslec BX55Z made by Sekisui Chemical Co., Ltd.) | 10 pbw |
| Slip agent (di-polyoxyethylene (2 mols) alkyl ether phosphate) (Nikkol DDP-2 made by Nikko Chemicals Co., Ltd.) | 3 pbw |
| Slip agent (erukamide) (Alflow P-10 made by Nippon Oil and Fats Co., Ltd.) | 1 pbw |
| Trifunctional polyisocyanate crosslinking agent (45 wt % solution) (Colonate L-45E made by Nippon Polyurethane Kogyo Co., Ltd.) | 10 pbw |
| Filler (calcium carbonate) ("Hakuenka DD" made by Shiraishi Calcium Co., Ltd.) | 1 pbw |
| Toluene | 100 pbw |
| MEK | 100 pbw |

COMPARATIVE EXAMPLE 1

The same procedure as in Example 1 was repeated to prepare a thermal transfer ink sheet of sublimation type, except that the back coat solution was replaced by that of the following composition.

| Back coat solution | |
|---|---|
| Heat-resistant binder (cellulose acetate) (L-70 made by Daicel Chemical Industries Co., Ltd.) | 10 pbw |
| MEK | 50 pbw |
| Cyclohexanone | 50 pbw |

COMPARATIVE EXAMPLE 2

The same procedure as in Example 1 was repeated to prepare a thermal transfer ink sheet of sublimation type, except that the back coat solution was replaced by that of the following composition.

| Back coat solution | |
|---|---|
| Heat-resistant binder (cellulose acetate) (L-70 made by Daicel Chemical Industries Co., Ltd.) | 10 pbw |
| Slip agent (acryl-silicone graft polymer, 30% solution) (Simac US380 made by Toagosei Chemical Industry Co., Ltd.) | 10 pbw |
| MEK | 50 pbw |
| Cyclohexanone | 50 pbw |

COMPARATIVE EXAMPLE 3

The same procedure as in Example 1 was repeated to prepare a thermal transfer ink sheet of sublimation type, except that the back coat solution was replaced by that of the following composition.

| Back coat solution | |
|---|---|
| Heat-resistant binder (cellulose acetate) (L-70 made by Daicel Chemical Industries Co., Ltd.) | 10 pbw |
| Slip agent (polyoxyethylene dodecyl phenyl ether phosphate) (Plysurf A208S made by Dai-ichi Kogyo Seiyaku Co., Ltd.) | 3 pbw |
| MEK | 50 pbw |
| Cyclohexanone | 50 pbw |

COMPARATIVE EXAMPLE 4

The same procedure as in Example 1 was repeated to prepare a thermal transfer ink sheet of sublimation type, except that the back coat solution was replaced by that of the following composition.

| Back coat solution | |
|---|---|
| Heat-resistant binder (cellulose acetate) (L-70 made by Daicel Chemical Industries Co., Ltd.) | 10 pbw |
| Slip agent (polyoxyethylene dodecyl phenyl ether phosphate) (Plysurf A208S made by Dai-ichi Kogyo Seiyaku Co., Ltd.) | 1 pbw |
| MEK | 50 pbw |
| Cyclohexanone | 50 pbw |

COMPARATIVE EXAMPLE 5

The same procedure as in Example 1 was repeated to prepare a thermal transfer ink sheet of sublimation type, except that the back coat solution was replaced by that of the following composition.

| Back coat solution | |
|---|---|
| Heat-resistant binder (cellulose acetate) (L-70 made by Daicel Chemical Industries Co., Ltd.) | 10 pbw |
| Slip agent (acryl-silicone graft polymer, 30% solution) (AS-005 made by Fujikura Kasei Co., Ltd.) | 33 pbw |
| Trifunctional polyisocyanate crosslinking agent (75 wt % solution) (Colonate L made by Nippon Polyurethane Kogyo Co., Ltd.) | 44 pbw |
| Acetone | 120 pbw |
| Cyclohexanone | 120 pbw |

COMPARATIVE EXAMPLE 6

The same procedure as in Example 1 was repeated to prepare a thermal transfer ink sheet of sublimation type, except that the back coat solution was replaced by that of the following composition.

| Back coat solution | |
|---|---|
| Heat resistant binder (polyvinyl butyral) (Eslec BX55Z made by Sekisui Chemical Co., Ltd.) | 10 pbw |
| Slip agent (sodium polyoxyethylene dodecylphenyl ether phosphate) (GAFAC RD720 made by Toho Kagaku Kogyo Co., Ltd.) | 8 pbw |
| Trifunctional polyisocyanate crosslinking agent (45 wt % solution) (Colonate L-45E made by Nippon Polyurethane Kogyo Co., Ltd.) | 80 pbw |
| Filler (calcium carbonate) ("Hakuenka DD" made by Shiraishi | 1 pbw |

-continued

| Back coat solution | |
|---|---|
| Calcium Co., Ltd.) | |
| Toluene | 100 pbw |
| MEK | 100 pbw |
| Catalyst (Di-n-butyltin dilaurate) (made by Tokyo Kasei Kogyo Co., Ltd.) | 0.05 pbw |

COMPARATIVE EXAMPLE 7

The same procedure as in Example 1 was repeated to prepare a thermal transfer ink sheet of sublimation type, except that the back coat solution was replaced by that of the following composition.

| Back coat solution | |
|---|---|
| Heat-resistant binder (polyvinyl butyral) (Eslec BX55Z made by Sekisui Chemical Co., Ltd.) | 10 pbw |
| Slip agent (polyoxyethylene dodecyl phenyl ether phosphate) (Plysurf A208S made by Dai-ichi Kogyo Seiyaku Co., Ltd.) | 5 pbw |
| Trifunctional polyisocyanate crosslinking agent (45 wt % solution) (Colonate L-45E made by Nippon Polyurethane Kogyo Co., Ltd.) | 30 pbw |
| Toluene | 100 pbw |
| MEK | 100 pbw |

COMPARATIVE EXAMPLE 8

The same procedure as in Example 1 was repeated to prepare a thermal transfer ink sheet of sublimation type, except that the back coat solution was replaced by that of the following composition.

| Back coat solution | |
|---|---|
| Heat-resistant binder (polyvinyl butyral) (Eslec BX55Z made by Sekisui Chemical Co., Ltd.) | 10 pbw |
| Slip agent (butyl stearate) (made by Kawaken Fine Chemical Co., Ltd.) | 4 pbw |
| Trifunctional polyisocyanate crosslinking agent (45 wt % solution) (Colonate L-45E made by Nippon Polyurethane Kogyo Co., Ltd.) | 10 pbw |
| Toluene | 100 pbw |
| MEK | 100 pbw |

Evaluation

Figure 4:
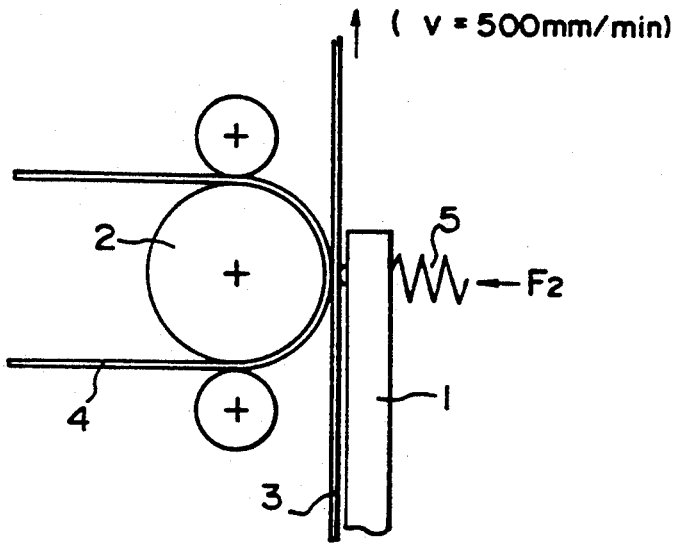
FIG. 4 is a schematic diagram showing the apparatus used to measure the kinetic friction coefficient.

The samples of the thermal transfer ink sheet of sublimation type which were prepared in Examples 1 to 8 and Comparative Examples 1 to 8 were tested for the kinetic friction coefficient at the time of printing and non-printing, using a printer-simulating apparatus as shown in FIG. 4.

The test was carried out in the following manner. With the rubber platen 2 (having a hardness 60°) and the printing paper 4 set free, the ink sheet 3 was pulled up at a constant rate (500 mm/min) in the direction of arrow using a tensile tester (Tensilon). With the printing pressure $F_2$ adjusted to 35 g/mm by means of the printing pressure adjusting spring 5, the load $F_1$ applied to the load cell was measured when printing was going on and not going on. The kinetic friction coefficient at the time of printing and non-printing was calculated from $\mu = F_1/F_2$. The thermal head 1 has a resistance of 1500 Ω. At the time of printing, the thermal head 1 was supplied with a pulse voltage (20 V, 14 ms pulse width, and 4 ms pulse interval). At the time of non-printing, the thermal head was not energized.

The load $F_1$ indicated by the load cell is a difference between the actual load and the load required to turn the platen 2 and run the printing paper 4. The load required to turn the free platen 2 (which was actually measured) was about 75 g, which is equivalent to a kinetic friction coefficient of about 0.02.

Figure 2:
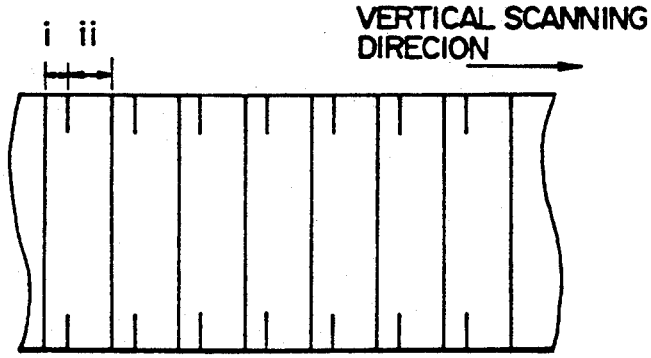
FIG. 2 is an image obtained by printing long and short lines alternately and repeatedly using the printer shown in FIG. 1.
Figure 3:
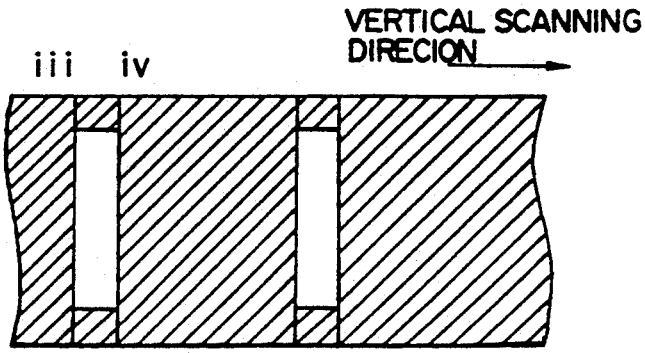
FIG. 3 is an image obtained by printing halftone with blanks using the printer shown in FIG. 1.

The printer (UP-5000 made by Sony Corporation), with its built-in ROM storing the same printing pattern as shown in FIGS. 2 and 3, was run to see sticking and printing pitch fluctuation. The results are shown in Table 1.

It is noted from Table 1 that the samples of the thermal transfer ink sheet of sublimation type prepared in Examples gave high-quality printing images without causing sticking and printing pitch fluctuation as compared with the samples prepared in Comparative Examples.

TABLE 1

| Example | $\mu_1$ | $\mu_2$ | $\mu_1/\mu_2$ | Sticking | Pitch fluctuation |
|---|---|---|---|---|---|
| 1 | 0.19 | 0.18 | 1.05 | A | A |
| 2 | 0.16 | 0.14 | 1.14 | A | B |
| 3 | 0.12 | 0.13 | 0.92 | A | A |
| 4 | 0.12 | 0.15 | 0.80 | A | B |
| 5 | 0.13 | 0.14 | 0.93 | A | A |
| 6 | 0.18 | 0.17 | 1.06 | A | A |
| 7 | 0.21 | 0.18 | 1.17 | A | B |
| 8 | 0.15 | 0.16 | 0.94 | A | A |
| (1) | >1.0 | 0.46 | — | C | — |
| (2) | 0.15 | 0.12 | 1.25 | B | C |
| (3) | 0.13 | 0.17 | 0.76 | B | C |
| (4) | 0.25 | 0.30 | 0.83 | C | — |
| (5) | 0.17 | 0.13 | 1.31 | B | C |
| (6) | 0.14 | 0.20 | 0.70 | B | C |
| (7) | 0.12 | 0.16 | 0.75 | B | C |
| (8) | 0.33 | 0.21 | 1.57 | C | — |

Rating for sticking and pitch fluctuation:
A: good
B: slight sticking and pitch fluctuation
C: poor Comparative Examples are indicated by parenthesized numbers.

Effect of the Invention

The thermal transfer ink sheet of the present invention runs smoothly without imposing unnecessary loads to the thermal head and hence gives rise to a high-quality print image free of print pitch fluctuation.

What is claimed is:

1. A thermal transfer ink sheet composed of a substrate, a thermal transfer ink layer formed on one side of the substrate, and a back coat layer formed on the other side of the substrate, the back coat layer being characterized as containing a slip agent in an amount of 5–35 wt % and having a kinetic friction coefficient between 0.05 and 0.25 with respect to the thermal head which varies depending on whether printing is going on or not, such that the back coat layer has a value of $\mu_1$ when printing is going on and a value of $\mu_2$ when printing is not going on, with the ratio of $\mu_1/\mu_2$ being from 0.8 to 1.2.

2. A thermal transfer ink sheet as defined in claim 1, wherein the slip agent in the back coat layer yields a kinetic friction coefficient when printing is going on and a kinetic friction coefficient when printing is not going on, with the ratio of $\mu_1/\mu_2$ being from 0.8 to 1.2.

3. A thermal transfer ink sheet as defined in claim 1, wherein the slip agent is tri(polyoxyethylene alkylether) phosphate represented by the formula (1) below $$[C_mH_{2m+1}-O-(CH_2CH_2O)_n-]_3-\overset{O}{\overset{\|}{P}} \quad (1)$$

(where m is an integer of 10–20, and n is an integer of 1–20)
or a glycerophospholipid or both.

4. A thermal transfer ink sheet as defined in claim 3, wherein the glycerophospholipid is at least one species selected from the group consisting of yolk lecithin, phosphatidylcholine, and phosphatidylserine.

5. A thermal transfer ink sheet as defined in claim 1, wherein the back coat layer contains a first slip agent that gives the back coat layer a kinetic friction coefficient which is higher when printing is going on than when printing is not going on, and a second slip agent that gives the back coat layer a kinetic friction coefficient which is lower when printing is going on than when printing is not going on, and wherein the first slip agent and the second slip agent are mixed in a ratio of from 1:10 to 10:1.

6. A thermal transfer ink sheet as defined in claim 5, wherein the first slip agent is at least one species selected from the group consisting of a long-chain fatty acid alkyl ester represented by the formula (2) below, $$R_1\overset{O}{\overset{\|}{C}}-OR_2 \quad (2)$$

(where $R_1$ denotes $C_{7-19}$ alkyl or alkenyl group, and $R_2$ denotes a $C_{1-20}$ alkyl group.)

a long-chain fatty acid amide represented by the formula (3) below, $$R\overset{O}{\overset{\|}{C}}-NH_2 \quad (3)$$

(where R denotes a $C_{7-19}$ alkyl or alkenyl group.)

paraffin wax, an alkyl phosphate represented by the formula (4) below, $$C_nH_{2n+1}O-\overset{O}{\overset{\|}{P}}(OH)_2 \quad (4)$$

(where n is an integer of 10–18)

and a lubricating polymer, and the second slip agent is at least one species selected from the group consisting of sodium polyoxyethylene oleyl ether phosphate represented by the formula (5) below, $$[C_{18}H_{35}O-(CH_2CH_2O)_n-]_m-\overset{O}{\overset{\|}{P}}(ONa)_{3-m} \quad (5)$$

(where n is an integer of 1–20, and m is 1 or 2)

polyoxyethylene dodecylphenyl ether phosphate represented by the formula (6) below, $$[C_{12}H_{25}-C_6H_4-O-(CH_2CH_2O)_n-]_m-\overset{O}{\overset{\|}{P}}(OH)_{3-m} \quad (6)$$

(where n is an integer of 1–20, and m is 1 or 2)

polyoxyethylene alkyl ether phosphate represented by the formula (7) below, $$[C_kH_{2k+1}-O-(CH_2CH_2O)_n-]_m-\overset{O}{\overset{\|}{P}}(OH)_{3-m} \quad (7)$$

(where k is an integer of 10–20, n in an integer of 1–20, and m is 1 or 2.)

and alkoxyl acid phosphate represented by the formula (8) below.

$$(C_nH_{2n+1}O)_m-\overset{O}{\overset{\|}{P}}(OH)_{3-m} \quad (8)$$

(where n is an integer of 20–24, and m is 1 or 2)

* * * * *